US008563904B2

(12) United States Patent
Cho

(10) Patent No.: US 8,563,904 B2
(45) Date of Patent: Oct. 22, 2013

(54) HEATED EYELASH CURLER

(76) Inventor: Yong Hoon Cho, Fullerton, CA (US)

( * ) Notice: Subject to any disclaimer, the term of this patent is extended or adjusted under 35 U.S.C. 154(b) by 0 days.

(21) Appl. No.: 11/998,108

(22) Filed: Nov. 28, 2007

(65) Prior Publication Data

US 2008/0105655 A1 May 8, 2008

Related U.S. Application Data

(62) Division of application No. 10/885,426, filed on Jul. 6, 2004, now Pat. No. 7,322,366.

(51) Int. Cl.
*H05B 1/02* (2006.01)

(52) U.S. Cl.
USPC ..... 219/501; 219/544; 219/552; 219/494

(58) Field of Classification Search
USPC ..... 219/494, 50, 497, 505, 538, 542, 544, 219/552
See application file for complete search history.

(56) References Cited

U.S. PATENT DOCUMENTS

| | | | | | |
|---|---|---|---|---|---|
| 3,970,823 | A | * | 7/1976 | Volk, Jr. | 219/546 |
| 5,475,203 | A | * | 12/1995 | McGaffigan | 219/548 |
| 5,888,429 | A | * | 3/1999 | Lovell | 252/502 |
| D429,375 | S | * | 8/2000 | Choi | D28/36 |

* cited by examiner

*Primary Examiner* — Mark Paschall
(74) *Attorney, Agent, or Firm* — Maria Erlinda C. Sarno

(57) ABSTRACT

A heated eyelash curler comprises a curling head portion having an arcuate top surface on one end and a protection case on the other end. The protection case serves as a handle and also encloses the power source. A heating element is laid on the arcuate top surface caged inside a plurality of bridges or protected between protruding comblike spikes. The curler includes a pigmented silicone piece which changes in color corresponding to the temperature of the heating element as indicator. The heating element comprises a conducting wire lined or coated with a high temperature insulation arranged in zigzag configuration inserted into a conducting tube. The circuitry includes a converter for boosting the voltage of the power source which hastens the rise in temperature of the heating element and this in combination with the heating element having the conducting wire in zigzag configuration, provide a more stable and even heating.

13 Claims, 6 Drawing Sheets

HEATED EYELASH CURLER

This is a divisional application of Ser. No. 10/885,426 filed on Jul. 6, 2004 now U.S. Pat. No. 7,322,366.

This invention relates to a heated eyelash curler. The heating element is uniquely set up to heat evenly and rapidly and is caged inside or between protective shields to prevent the skin from directly touching the heating element as well as protect the girth of the eyes from harm.

BACKGROUND

Most eyelash curler shape the eyelashes purely by mechanical pressure by inserting the eyelashes between two pinching elements, mostly arched to conform with the shape of the eyelids. U.S. Pat. No. 6,230,715 proposed the incorporation of a heating element into the pinching elements to hasten the curling process as well as result into a longer lasting curl. In this invention, the eyelashes are curled by a simultaneous application of heat and pressure. As in the current eyelash curlers, the eyelashes are likewise inserted between two pinching elements or forming members having an eyelash-line shape except that a heating member is incorporated into the forming members. The heat is preferably controlled to a desired temperature. A silicon pad is attached to one of the forming members, the upper forming member, which is designed to closely conform to the lower part of the forming member. The silicon here provides a pad as well as insulates the upper forming member from heat to prevent burning of the eyelids. The device uses a light emitting diode (LED) as indicator to indicate heater status by turning on a red LED when the power switch is "on" and by subsequently turning on a green LED when the heater is at a proper eyelash curling temperature. This optionally adopts a mechanism wherein the red and green LED rapidly turn on and off repeatedly when the power source is low such as when the battery is low-charged. Here, the heating element, does not provide a stable heat and does not have a protective shield caging or surrounding the heating element to prevent the hands or skin around the eye from touching its surface. More importantly, the eyelashes still have to be inserted between two pinching or forming elements which is hard for a novice, consequently, discouraging them from using the device, especially by those having short eyelashes. Further, the rate of the heating process in achieving the desired temperature is not at optimum.

It is therefore an object of this invention to provide an eyelash curler having a heating element but without the need of inserting the eyelashes between two forming elements.

It is also an object of this invention to provide an eyelash curler with a curling head having a heating element surrounded by a shield to prevent skin burns.

It is a further object of this invention to provide an indicator that directly touches on the surface of the heating element to provide a more accurate indication of the temperature in addition to the LED indicators that are voltage driven.

It is also a further object of this invention to provide an eyelash curler that achieves the desired curling temperature at a faster rate.

BRIEF DESCRIPTION OF THE DRAWING

FIG. 2A is an enlarged picture of a segment of the curling head portion of the upper casing showing in more detail, the protective shield, the openings on the bridges and the slit underneath the bridges.

SUMMARY OF THE INVENTION

This invention relates to a heated eyelash curler, comprising a curling head portion having an arcuate top surface on one end and a protection case on the other end. The protection case serves as a handle for the device. The curling head portion includes a heating element laid on the arcuate top surface caged inside a plurality of bridges or protected between protruding comblike spikes. The eyelash curler, herein also referred to simply as curler, can also have both, bridges and comblike spikes with the latter lining horizontally parallel to the bridges and the heating element. The protection case encloses the power source for the heating element which is usually a battery. A pigmented silicone piece which changes in color corresponding to the temperature of the heating element is directly contacted with the heating element for fast and accurate response. The eyelash curler may be designed with a plain heating mechanism which just turns the heating element on or off. Preferably, the heating mechanism will not only shut on or off but will control as well as keep the heating element at the desired curling temperature. The eyelash curler has an indicator, preferably a light emitting diode (LED), to signal when the heater curler, two LEDs, one emitting one color of light when the curler is on but below a desired temperature and another emitting another color when the curler is at the desired temperature are desirable to provide additional safety and notice to the user when the curler is ready to use. The heating element comprises a conducting coil or wire in zigzag configuration inserted into a conducting tube such as a brass tubing coated on the outside surface with a non-sticking material such as teflon. The recommended heating mechanism for circuitry for the heating element includes a converter for boosting the voltage of the power source if the output is below approximately 5 volts. This will hasten the rise in temperature of the heating element and in combination with the heating element having the conducting coil or wire lined or coated with a high temperature insulation in zigzag configuration, will provide a more stable and even heating. Additionally, the eyelash curler can have an indicator to notify the user when the power source is low.

Further scope of applicability of the present invention will become apparent from the detailed description and the accompanying drawings. However, it should be understood that the detailed description are given only as illustration on how to implement the proposed invention since various changes and modifications within the spirit and scope of the invention will become apparent to those skilled in the art from this detailed description.

DETAILED DESCRIPTION OF THE INVENTION

Figure 1:
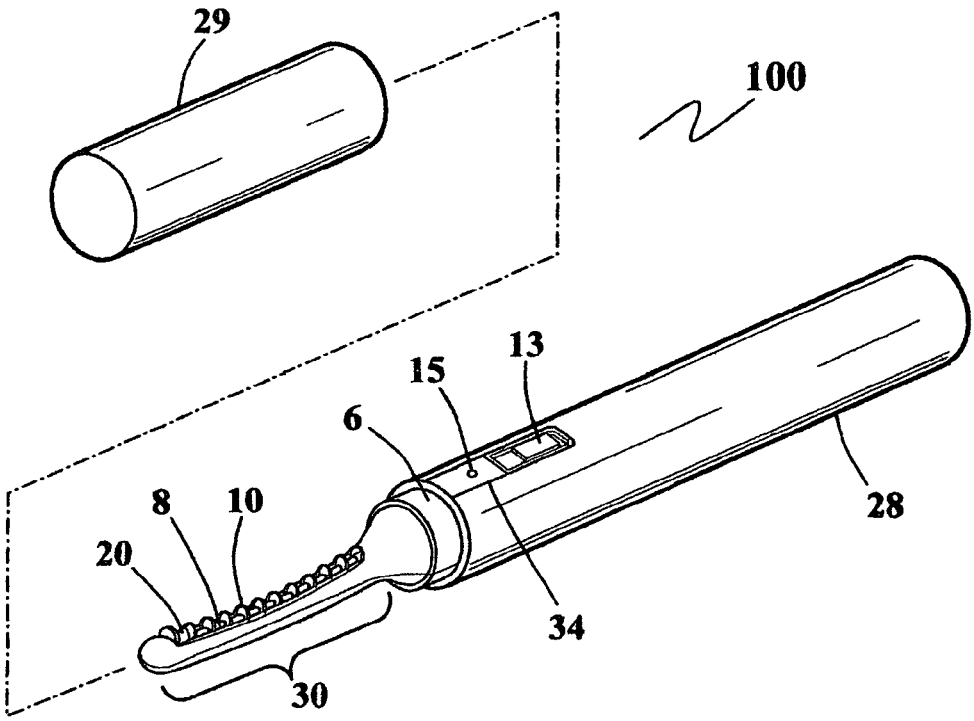
FIG. 1 is a perspective view of the heated eyelash curler.
Figure 2:
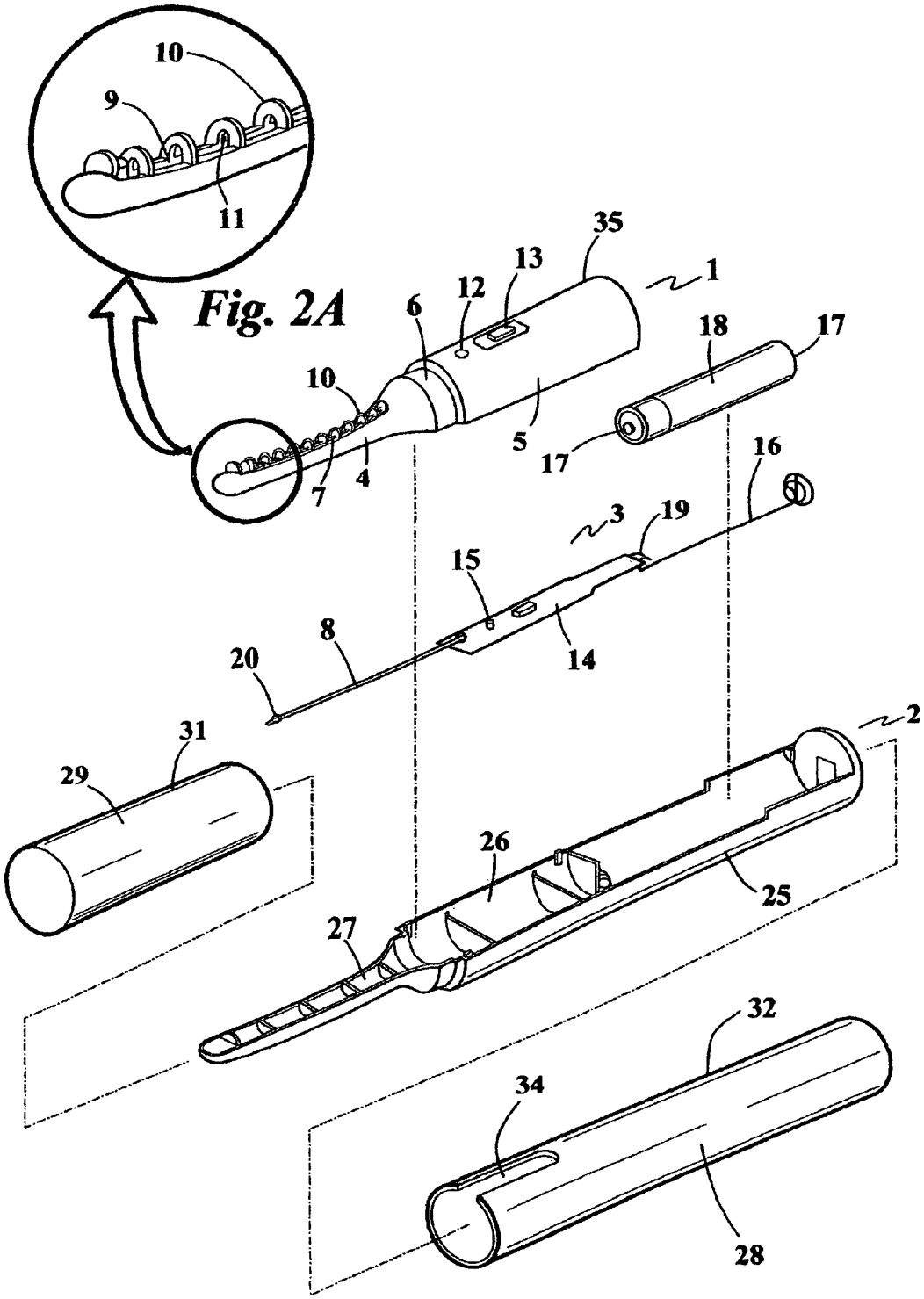
FIG. 2 is an exploded view showing the assembly of the parts making up the eyelash curler of FIG. 1.

FIG. 1 shows a perspective view of the heated eyelash curler 100. FIG. 2 shows the parts and an example on how these parts are assembled. The eyelash curler 100 shown on FIG. 2 basically have three major components or parts, an upper casing 1, a lower casing 2 and a middle heater component 3. The middle component 3 is sandwiched between the upper casing 1 and the lower casing 2 before the upper and the lower casings 1 and 2 are attached together.

Figure 6:
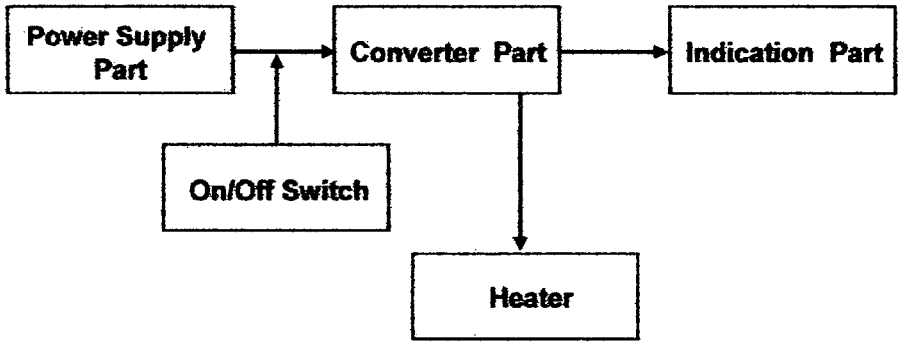
FIG. 6 is a block diagram of a heating mechanism having a heat control and an LED indicator for denoting on and off switching of the device.
Figure 7:
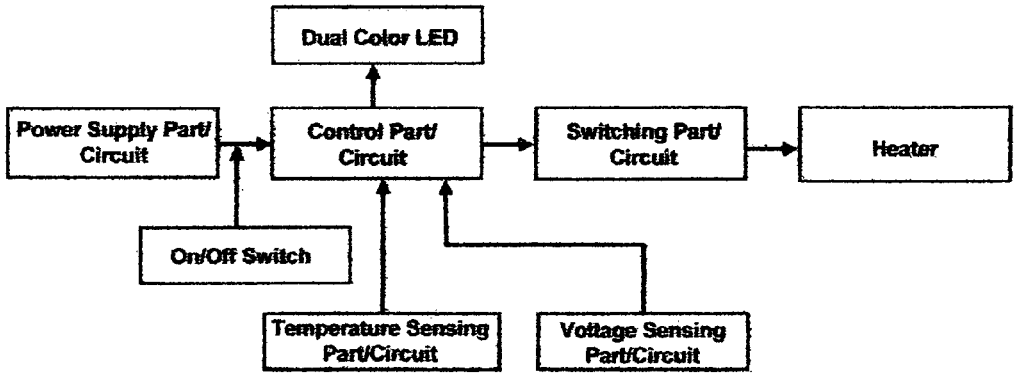
FIG. 7 is a block diagram of a heating mechanism having a heat control and LED indicators to show when the curling temperature is at its optimum.

The upper casing 1 includes a head piece 4 and a half cylindrical shaped rear piece 5 with a recessed neck 6 between the head and the rear pieces 4 and 5. The head piece 4 has an arcuate top surface 7 shaped to cause an upward curl after several repeated strokes of the eyelashes on a heating element 8. The arcuate top surface 7 has a slit 9 running horizontally along the head piece 4 where the heating element 8 is introduced to lay above the slit 9. Along the arcuate top surface 7, at the location where the heating element 8 will sit, are a plurality of small bridges 10 running perpendicular from the slit 9. As shown in FIGS. 1, 2, 2A and 3, the bridges 10 protrude from the arcuate top surface 7 to result in a space 11 beneath the bridges 10, between the arcuate top surface 7 and the bridges 10. The heating element 8 situates in this space 11 resulting in the heating element 8 being caged by the bridges 10. The rear piece 5 has an opening 12 for an indicator 15 such as a light emitting diode (LED) if the device will incorporate one and a switch 13 installed on its surface usually aligned with the arcuate top surface 7. The neck portion 6 is also shaped as a half cylindrical piece but of a smaller diameter and is recessed from the rear piece 5. The middle component 3 includes the heating element 8 on one end connected to a plate 14, the plate 14 holding the LED indicator 15, if incorporated, and the electrical connections for the switch 13. The plate 14 may be flat or curved to conform with the shape of the interior of the upper casing 1. Attaching likewise to the plate 14, at the opposite end of the heating element 8 is a connecting wire 16 that provides connection between charged terminals 17 of a power source, herein as example, a battery 18 when this is placed in between the connecting wire 16 and a conducting strip 19. The strip 19 usually projects from the plate 14 but bends inwards as shown in FIG. 2 to be coaxial with the connecting wire 16 in order to make good contact with the charged end of the battery 18. Those skilled in the art can easily modify the electrical connections to be able to use the power source aside from the battery 18. Near the tip of the heating element 8 is introduced a silicone piece 20, preferably shaped like a ring for easy introduction into and around the heating element 8. Direct contact between the silicone piece 20 and the heating element 8 provides a more reliable method for detecting the temperature because the silicone piece 20 contains a pigment that changes its color with temperature. This pigmented silicone material can be purchased from Zhejiang Xinan Chemical Industrial Group Co., Ltd. having a website: www.xinanchem.com. At room temperature, the color of the chosen pigmented silicon piece 20 is purple. The purple color gradually changes to opaque white or colorless as the temperature of the heating element 8 rises. When the heating element 8 is at the desired temperature, for example between 60-70 degrees Centigrade, the color of the chosen pigmented silicone piece 20 is opaque white or colorless. A user is notified that the eyelash curler 100 is heated when the silicone piece 20 has lost its purple color. For the eyelash curler 100 without a temperature or heat control, when the switch 13 is turned 'on', the LED indicator 15, if incorporated in the curler 100, turns on and the heating element 8 gets its power directly from the power source. For this type of eyelash curler 100, the user should turn the switch 13 off as soon as the eyelashes are curled. There may be a need to turn the switch 13 on and off to prevent overheating. For temperature controlled curlers, the user does not have to worry about the curler getting overheated. The circuit shown on FIG. 6 shows the heating process with a temperature control and FIG. 7 shows the heating process, additionally incorporating two indicators instead of one, for example, one LED indicator turning red when the heating element 8 is heated but below the desired temperature and another LED indicator turning green when the heating element 8 is at the desired temperature.

Figure 3:
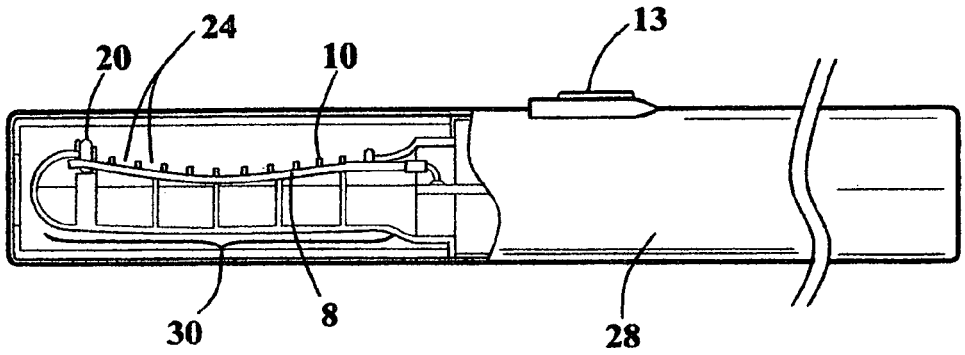
FIG. 3 is a cross sectional view of the assembled curling head portion of the device shown inside its casing.
Figure 4A:
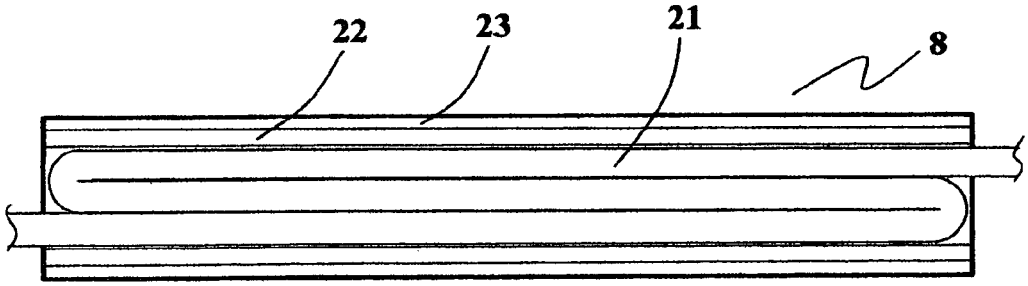
FIG. 4A is a cross sectional view of the heating element showing the zigzag arrangement of the heating coil inside a conducting tube.
Figure 4B:
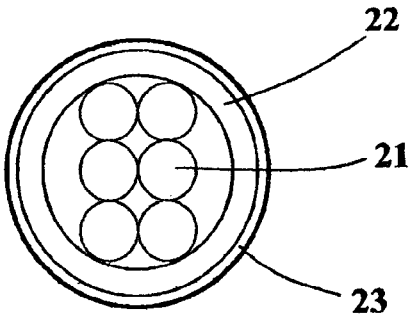
FIG. 4B is a cross sectional view of the zigzag arrangement of the heating coil inside the conducting tube shown in FIG. 4A.

The heating element 8 comprises as shown in FIGS. 4A and 4B a conducting wire 21 lined or coated with a high temperature insulation in zigzag configuration along the length of the heating element 8. This conducting wire 21 is usually made from chromium and nickel. The proposed zigzag configuration is unique and forms a major part of the claimed eyelash curler 100. This configuration maximizes the generation of heat and allows the temperature to rise up at a faster rate as well as keep the heating process regular, that is, not fluctuating and evenly distributed throughout the heating element 8, due the increased surface area resulting from the zigzag configuration of the conducting wire 21, thereby enabling the user to curl the eyelashes quickly and consequently, allowing the battery 18 to last longer. The zigzag wire 21 is placed inside a conducting tube 22 such as a brass tubing which is in turn coated with a non-sticking material 23 such as Teflon on its outside surface to keep the eyelash from directly contacting and sticking on the brass tubing 22 which can cause burning of the eyelashes. The length of the conducting tube or brass tubing 22 dictates the length of the heating element 8. The number of zigzag turns is usually limited by the diameter of the wire 21 and the conducting tube 22. The heating element 8 is introduced into the upper casing 1 by squeezing the heating element 8 into the slit 9, to situate on the space 11 underneath the bridges 10 as shown in FIGS. 1 and 3. Since the bridges 10 protrude from the arcuate top surface 7, the bridges 10 prevent the skin directly contacting the heating element 8 but allow the eyelashes direct contact for optimum curling. The bridges 10 also serve as a guide for the eyelashes, just like a comb, because the eyelashes enter at the intervals or spaces 24 between the bridges 10. Vertically protruding blunt or round ended comblike spikes, similar to the teeth of a comb or brush, may be incorporated to line horizontally along the ends of the bridges 10 for added protection from burns and to assist in guiding the eyelashes. These comblike projections may also substitute for the bridges 10, with the heating element 8 placed between two rows of the comblike projections, if desired.

The lower casing 2 is also a hollow half cylindrical casing designed to match and attach to the upper casing 1, forming a hollow enclosed piece of the head, neck and rear pieces 4, 6 and 5 of the upper casing 1 and leaving an open half cylindrical tail portion 25, serving as the housing for the conducting connecting wire 16 and the power source, in this illustration, the battery 18. As shown in FIG. 2, an interior 26 of the lower casing 2 facing the bottom of the rear piece 6 of the upper casing 1 have compartments to house the LED indicator 15 and the electrical circuit connecting to the switch 13, the latter allowing the completion of the contact, consequently the circuit, to commence heating when the switch 13 is placed in the "on" position. The positive charge terminal of the battery 18 usually contact the conducting strip 19 while the negative charge terminal contacts the connecting wire 16. At the interior 26 located opposite the head piece 4 are solid strips protruding perpendicularly from an internal wall 27 of the lower casing 2 to support the heating element 8 and keep this on the top surface 7 of the head piece 4 or the resulting curling head portion after the upper casing 1 is attached to the lower casing 2.

Figure 5:
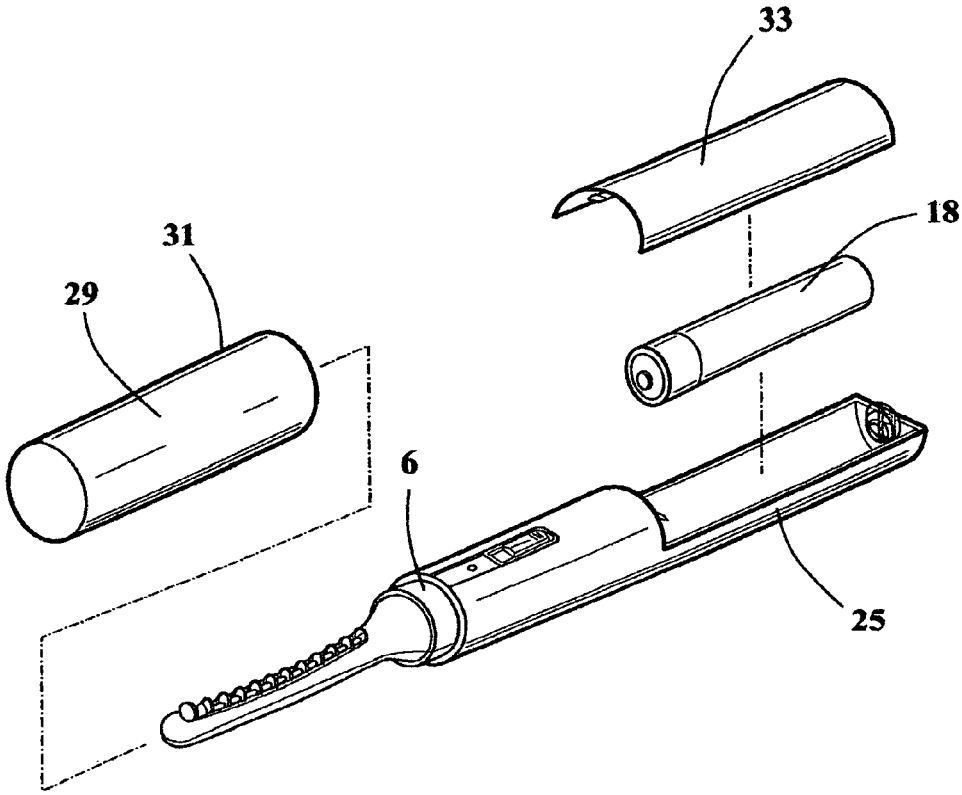
FIG. 5 shows an exploded view of an alternate design for casing the heated eyelash curler.

The open exposed tail portion 25 of the lower casing 2 can be covered by means known in the art. One way is shown in FIG. 2 where a protection case 28 completely envelopes both the hollow enclosed rear piece 5 and the exposed tail portion 25 to encase the battery 18 as shown in FIG. 5 since the other parts or components of the eyelash curler 100 are already enclosed. The body opposite the curling head portion resulting after the application of the cover shown in FIG. 5 or the protective case 28 serves as the housing for the electrical circuitry involved with the heating of the heating element 8 as well as the handle for the curler 100. In both designs, a cap 29 is preferably but not necessarily used to cover a curling head portion 30 of the eyelash curler 100 as shown in FIGS. 1 and 2. The cap 29 inserts with its internal walls (not shown) snugly fitting into the recessed neck 6 of the eyelash curler 100 and an outside surface 31 of the cap 29 aligning with an outside surface 32 of the protective case 28 or with the body resulting from a cover 33 enclosing the battery 18 situated at the exposed tail portion 25. The protective case 28 has an etched out opening 34 to accommodate the switch 13 on a top surface 35 of the upper casing 1. The casings 1 and 2, the protective cover or case 28 and the cap 29 may be made of plastic such as acrylonitrile butadiene styrene and equivalents or nonconducting metals such as aluminum.

Figure 6A:
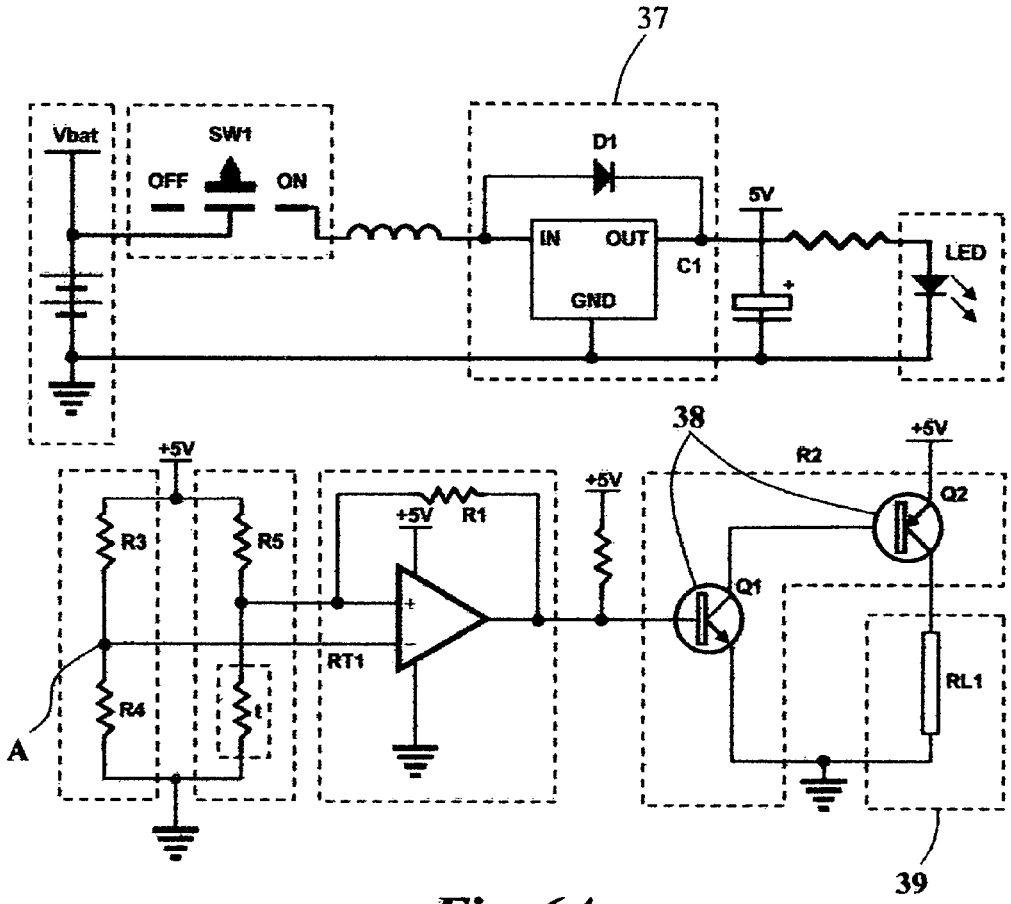
FIG. 6A is a circuit diagram of the heating mechanism shown in FIG. 6.
Figure 7A:
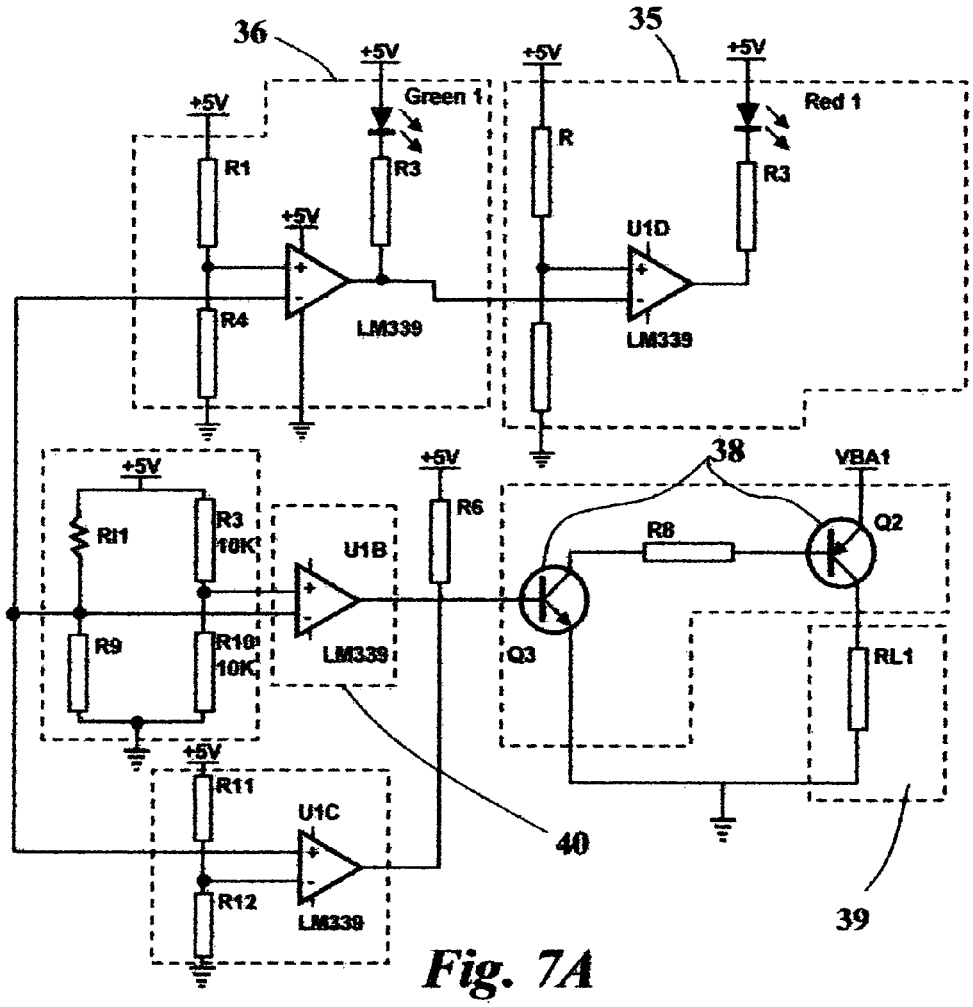
FIG. 7A is a circuit diagram of the heating mechanism shown in FIG. 7.

The heated eyelash curler 100 can simply be heated without any temperature control by switching the power to the "on" position. If the indicator 15 is used, the LED indicator 15 customarily will emit a red color. The temperature, in this case, is manually controlled by turning the power switch 'on' or 'off' according to the signal provided by the silicone piece 20 as shown in FIGS. 6 and 6A. Preferably, however, the temperature of the heating element 8 is controlled as shown in FIGS. 6, 6A, 7 and 7A. The power supply circuit and a converter 37 for FIGS. 7 and 7A is the same as that shown in FIGS. 6 and 6A excepting the single LED on FIGS. 6 and 6A which was replaced with two LEDs when the temperature of the heating element 8 is controlled as shown in FIGS. 7 and 7A. LED indicators 35 and 36 as shown in FIGS. 7 and 7A will turn red when the power is 'on' and will turn green when the heating element 8 is at the desired temperature. At least one indicator, together with the silicone piece 20 provides a better safeguard for the user. Optionally, in order to avoid the disappointment of having an nonoperational eyelash curler when needed, the LED indicator/s 35 and 36 can be wired to emit a flickering light when the power coming from the battery 18 is low, indicating the need of replacement. In the heating mechanisms shown in FIGS. 6, 6A, 7 and 7A, the converter 37 boosts the voltage coming from the power source, for example, 2.4 volts from the battery 8 to that required by the device to quickly curl the eyelashes which is approximately 5 volts. Current heating mechanisms for eyelash curlers 100 do not have the converter 37, relying solely from the voltage output of the battery 18. Consequently, the rate of heating is slow and the achieved temperature may be lower than desired. This converter 37 in the battery heated eyelash curler 100 together with the zigzag configuration of the conducting coil or wire 21 makes the heating mechanism of this claimed eyelash curler 100 superior in performance. Transistors 38 adjusts the voltage according to the temperature of a heater 39 to limit the amount of the electric current sent to the heater 39 as shown in FIGS. 6 and 6A or maintain a constant temperature as shown in FIGS. 7 and 7A. The design shown in FIGS. 7 and 7A adds a voltage comparator 40 which compare the signals from the temperature and/or voltage sensors and optically represent the heater status on a two LED indicator system and/or the charged condition of the power source which constitute part of the heating mechanisms shown in FIGS. 7 and 7A.

To use the curler 100, one simply let the eyelashes enter the spaces 24 between the bridges 10 and/or comblike projections until the eyelashes touches on the heating element 8 unlike the conventional curlers which require the eyelashes to situate between two pinching or forming elements, requiring manual dexterity and experience. The eyelashes curl after a few repeated upward strokes against the heating element 8.

While the embodiments of the present invention have been described, it should be understood that various changes, adaptations, and modifications may be made therein without departing from the spirit of the invention and the scope of the claims.

I claim:

1. A heating mechanism for use with a temperature controlled eyelash curler, comprising:

an electrically conducting heating element having a conducting wire in zigzag configuration inserted into a conducting tube coated on an outer surface with a non-sticking material connected to a power source by a connecting wire for heating the heating element, the conducting wire lined or coated with a high temperature insulation; and, a converter to boost the voltage from the power source for hastening the rise in temperature of the heating element.

2. The heating mechanism of claim 1 wherein the conducting tube is a brass tubing.

3. The heating mechanism of claim 1 wherein the power source is a battery.

4. The heating mechanism of claim 1 wherein the conducting wire is made of chromium and nickel.

5. The heating mechanism of claim 1 wherein the zigzag configuration is made up of a number of turns limited by the diameter of the conducting wire and the conducting tube.

6. The heating mechanism of claim 1 wherein the heating element is connected to a plate holding an LED indicator and electrical connections for a switch.

7. The heating mechanism of claim 1 wherein the heating element radiated heat within a temperature range from about 60° C. to 70° C.

8. A heating mechanism for use with a temperature controlled device, comprising:

an electrically conducting heating element having a conducting wire in zigzag configuration inserted into a conducting tube coated on an outside surface with a non-sticking material connected to a power source by a connecting wire for heating the heating element, the connecting wire lined or coated with a high temperature insulation; and, a converter to boost the voltage from the power source for hastening the rise in temperature of the heating element.

9. The heating mechanism of claim 8 wherein the conducting tube is made of brass and the conducting wire is made of chromium and nickel.

10. The heating mechanism of claim 8 wherein the power source is a battery.

11. The heating mechanism of claim 8 wherein the zigzag configuration is made up of a number of turns limited by the diameter of the conducting wire and the conducting tube.

12. The heating mechanism of claim 8 wherein the heating element is connected to a plate holding an LED indicator and electrical connections for a switch.

13. The heating mechanism of claim 8 wherein the heating element radiated heat within a temperature range from about 60° C to 70° C.

* * * * *